US005114500A

United States Patent [19]

Tahara et al.

[11] Patent Number: 5,114,500

[45] Date of Patent: May 19, 1992

[54] NITRIDING FURNACE APPARATUS AND METHOD

[75] Inventors: Masaaki Tahara, Takatsuki; Haruo Senbokuya, Tondabayashi; Kenzo Kitano, Kawachinagano; Teruo Minato, Hashimoto, all of Japan

[73] Assignee: Daidousanso Company Ltd., Osaka, Japan

[21] Appl. No.: 560,694

[22] Filed: Jul. 31, 1990

[30] Foreign Application Priority Data

Dec. 22, 1989 [JP] Japan ..... 1-333425

[51] Int. Cl.[5] ..... C21D 1/48

[52] U.S. Cl. ..... 148/230; 266/257; 148/238

[58] Field of Search ..... 266/252, 255, 257; 148/16.6, 14, 20.3

[56] References Cited

U.S. PATENT DOCUMENTS

| | | | |
|---|---|---|---|
| 2,205,258 | 6/1940 | Hansen | 148/16 |
| 4,003,764 | 1/1977 | Wünning | 148/16.6 |
| 4,016,111 | 4/1977 | Asai et al. | 148/16 |
| 4,183,773 | 1/1980 | Kawasoko et al. | 148/16 |
| 4,395,025 | 7/1983 | Watanabe et al. | 266/257 |
| 4,807,853 | 2/1989 | Murakami et al. | 266/252 |
| 5,013,371 | 5/1991 | Tahara et al. | 148/16.6 |

*Primary Examiner*—Scott Kastler

*Attorney, Agent, or Firm*—Armstrong, Nikaido, Marmelstein, Kubovcik & Murray

[57] ABSTRACT

This invention makes a furnace body divide into two, a pretreating chamber and a nitriding chamber by an opening and closing center wall. After pretreating works to be treated in the pretreating chamber, the opening and closing center wall is opened and the pretreated works are transferred to the nitriding chamber to nitride them. Treatment gas can be saved largely compared with the case that the nitriding is conducted after pretreating works in a furnace which has only a nitriding chamber.

4 Claims, 3 Drawing Sheets

NITRIDING FURNACE APPARATUS AND METHOD

BACKGROUND OF THE INVENTION

1. Technical Field

This invention relates to a nitriding furnace apparatus which is used for forming a nitrided layer on the surface of steel material.

2. Prior Art

A technology for forming a nitrided layer on the surface of steel material is utilized widely from a respect of carrying out hardening the steel surface to improve characteristics such as weal resistance. Such nitriding is conducted as follows. A clean surface is exposed by pretreating to remove a passive surface coat layer such as an oxidized layer and in that state the clean surface is contacted with nitrogen source gas such as ammonia to penetrate and diffuse inside the steel. Generally the pretreatment to the surface of the steel material, in particular the steel material containing a large amount of Cr, is carried out by cleaning the steel surface with a hydrofluoric acid-nitric acid mixture.

However, it is difficult to remove the stubborn passive coat layer on the surface of stainless steel, particularly austinitic stainless steel, even with the cleaning with the hydrofluoric acid-nitric acid mixture, and even if the passive coat layer is removed, it is likely to be reformed before reaching nitriding temperature. For this reason, it is practically impossible to form a nitrided layer with sufficient thickness on the steel surface uniformly due to the remaining passive coat layer in a conventional nitriding. Improvement has been required.

The present invention recognizes that the pretreating prior to nitriding influences a state of the nitridine largely. As a result, it was found to be quite effective to hold the steel material in the atmosphere of fluorinated gas using the fluorinated gas containing at least one fluorine source gas selected from $NF_3$, $BF_3$, $CF_4$, HF, $SF_6$ & $F_2$ in an inert gas such as $N_2$. That is, when the steel material is held in said atmosphere in a heated state, a passive coat layer on the steel surface turns into a fluorinated layer by action of an active F atoms of said fluorinated gas. The fluorinated layer is decomposed by $H_2$, $NH_3$ or a small amount of water to expose the steel surface in a bare state. Since the bare state metallic surface is cleaned and activated, it is easy for N atoms to penetrate/diffuse from the steel surface to the inside thereof when nitriding. The inventors have filed a patent application based on this concept entitled "A method of nitriding steel", as Japanese patent Application No. 1-177660. The method thereof is carried out by using a heat treatment furnace of which the inside comprises one chamber as shown in FIG. 3. That is, the steel material (not shown) put in a metallic container 2 is charged into said furnace 1 and heated at the temperature of about 300° C.~400° C. by a heater 3. And the steel material is pretreated by introducing fluorinated gas, in which $NF_3$ is contained in $N_2$ gas, into the furnace 1 through gas inlet pipe 4. Then, after finishing the pretreatment, said fluorinated gas is taken out through a gas exhaust pipe 5 and released to outside, subsequently the heater 3 is electrically loaded to raise the temperature of the steel material to 400° C.~600° C. In that state, mixed gas (e.g. $NH_3$: 50%, $CO_2$: 10%, CO: a small amount, $H_2$: a small amount, $N_2$: rest) is introduced to the furnace 1 through said pipe 4 to nitride the steel material. In this case, a fluorinated layer formed on the steel surface with $H_2$, $NH_3$ and the like in said mixed gas is destroyed to expose the metal surface, N atoms from $NH_3$ acts against the exposed activated metal surface to form a nitrided layer deeply and uniformly on the steel surface. However, in the heat treatment furnace 1 with this structure, since said pretreatment and nitriding are conducted in one furnace, the following problems arise. That is, in said pretreatment, fluorinated gas is introduced into said furnace 1. $NF_3$ which is an effective ingredient in the fluorinated gas acts not only against the steel surface but also against inner wall surfaces of the heat treatment furnace 1 to form a fluorinated layer thereto. The formed fluorinated layer is decomposed and removed when subsequent nitriding as well as that on the steel material surface. Therefore, $NF_3$ used for covering the inner wall surface of the heat treatment furnace 1 is uneconomical. The fluorinated layer thus decomposed and removed from the inner wall of the furnace 1 reacts on ammonia used in nitriding to be $NH_4F$ finally and it is exhausted to outside. Not only the fluorinated layer on the steel surface but also that on the inner wall of the furnace 1 are turned into $NH_4F$ to be exhausted. Thereby, there is a problem that an exhaust pipe 5 of the heat treatment furnace 1 is easily filled with $NH_4F$ too much and stopped up because the produced amount of $NH_4F$ is too large. Furthermore, it is necessary to cool the nitrided steel in the furnace 1 after said nitriding, but there is another problem in that since the whole furnace is heated by the heat for nitriding, temperature of the steel material does not go down easily and it takes more than 4 hours for cooling it. In FIG. 3, the reference numeral 6 indicates an adiabatic wall, the numeral 7 an opening and closing door, 8 fans, 9 a frame, 10 a column for a frame, 11 a column of furnace body, 12 a vacuum pump, and 13 an exhaust gas treatment apparatus.

SUMMARY OF THE INVENTION

Accordingly, it is an object of this invention to provide a furnace apparatus for nitriding by which the amount of fluorinated gas used for pretreating can be reduced and saved, and at the same time stopping up of the gas exhaust pipe with $NH_4F$ and the like produced by decomposition of the fluorinated layer formed on the inner wall of the furnace is not caused, and yet the steel material after nitriding can be cooled swiftly.

DISCLOSURE OF THE INVENTION

To accomplish the above-mentioned object, this invention provides a nitriding furnace apparatus comprising a furnace body, a heating apparatus disposed in said furnace body, a feeding pipe for treatment gas and an exhaust pipe for the treatment gas, characterized in that the apparatus further comprises an opening and closing center wall for dividing the inside of said furnace body into two, a nitriding chamber and a pretreating chamber, a support frame for supporting works to be treated disposed movably between said two chambers.

That is, in this furnace apparatus for nitriding the furnace body is divided into two, a pretreating chamber and a nitriding chamber. The above-mentioned pretreatment is carried out in the pretreating chamber. Therefore, $NF_3$ which is an effective ingredient of fluorinated gas fed to the pretreating chamber acts not only on steel work surface but also on wall surfaces of the pretreating chamber. However, since the fluorinated layer is not decomposed and removed in the pretreating chamber, the fluorinated layer adhered to the wall surface at the first pretreating remains as it is. Therefore, at next pretreating, a fluorinated layer can hardly be formed anew on the wall of the pretreating chamber, and $NF_3$ acts only on the steel surface to be treated to change a passive coat layer thereon to a fluorinated layer. As a result, $NF_3$ consumed actually is only for acting on the steel surface and used amount of the fluorinated gas decreases greatly. Furthermore, the fluorinated layer which is formed on the wall surface of the pretreating chamber at the first pretreating is not removed as mentioned before. Therefore, stopping up an exhaust gas pipe due to formation of $NH_4F$ come from the fluorinated layer on said wall surface does not occur. The pretreated steel surface in the pretreating chamber is subsequently introduced to the nitriding chamber by opening a center wall and nitrided after closing the center wall. Since the pretreating chamber is not heated during the nitriding, it is allowed to cool naturally. Then, the steel material after nitriding is returned to the pretreating chamber again by opening and closing the center wall and is cooled therein. In this case, since the pretreating chamber is in a state of letting cool and the temperature therein is considerably lower than that of the nitriding chamber, cooling time can be shortened.

Followings are descriptions of embodiments.

EMBODIMENT 1

Figure 1:
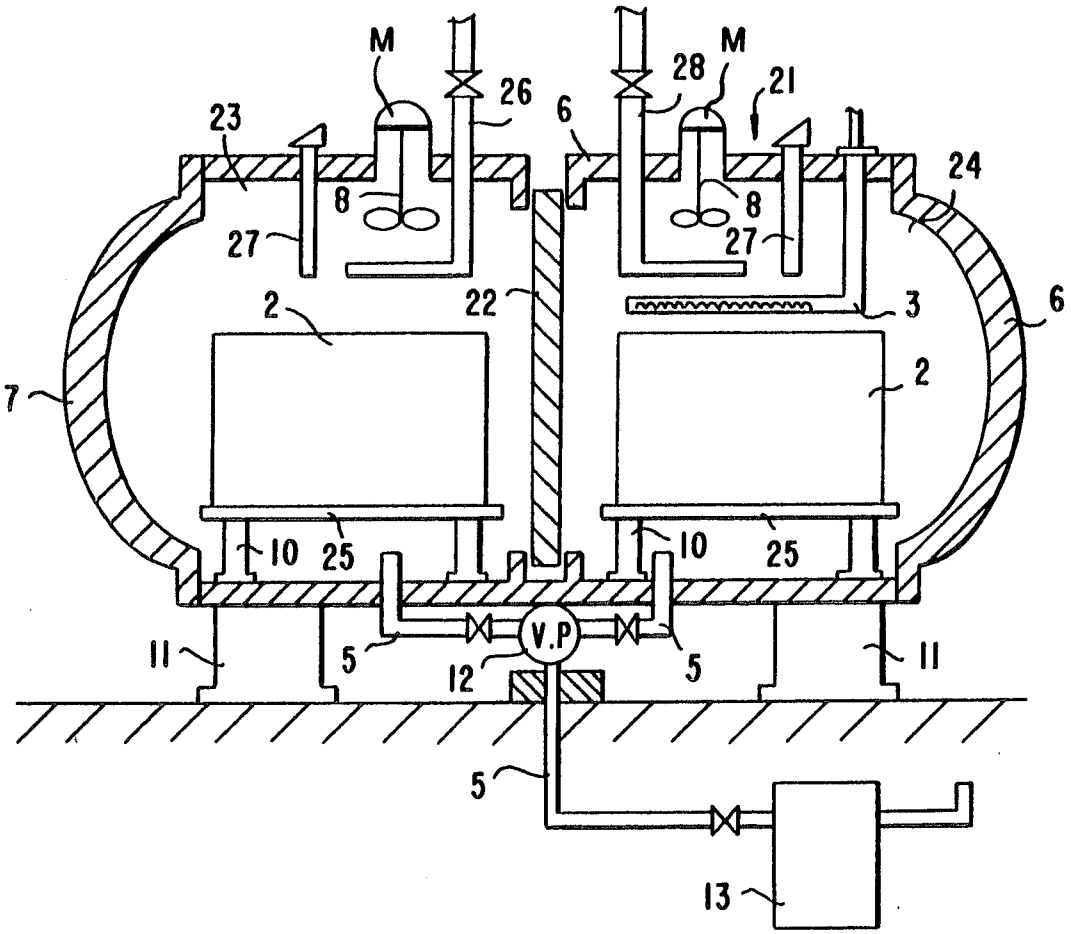
FIG. 1 shows a cross-sectional view of an embodiment according to the invention.
Figure 3:
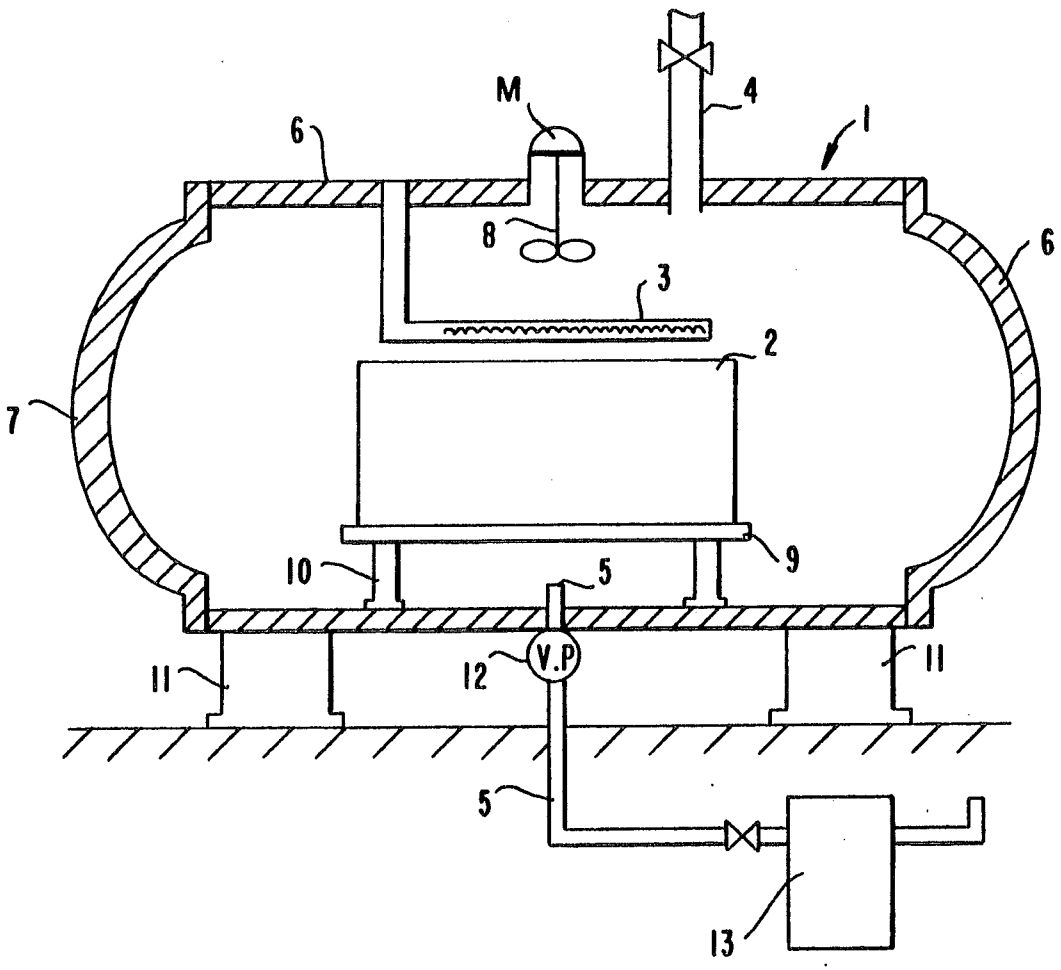
FIG. 3 shows a cross-sectional view of a treatment furnace which is a base of the invention.

FIG. 1 illustrates an embodiment according to the invention. In this figure, the reference numeral 21 refers to a furnace body having an adiabatic wall and the inside thereof is divided into two, right and left chambers 23, 24 by an opening and closing center wall 22. The center wall 22 is for dividing the two chambers 23, 24 in an airtight and adiabatic state. The center wall 22 slides up and down in the drawing for opening and closing. The numeral 23 refers to a pretreating chamber and 24 refers to a nitriding chamber. A frame 25 is formed to support a metallic net basket 2 which holds the steel works in the pretreating chamber 23 and the nitriding chamber 24. The frame 25 comprises a pair of right and left rails, and the metallic net baskets 2 slid on these rails to be introduced in the pretreating chamber 23 and the nitriding chamber 24. The numeral 26 refers to a gas inlet pipe for introducing fluorinated gas into the pretreating chamber 23 and the numeral 27 refers to temperature measuring sensors. A front opening of the pretreating chamber 23 is lidded for opening and closing with a lateral-open type opening and closing lid. The reference numeral 28 indicates a nitriding gas inlet pipe for introducing nitriding gas into the nitriding chamber 24. Other parts are the same as those in FIG. 3, so that same reference numerals indicate the same parts.

In this structure, the temperature inside the nitriding chamber 24 raised to 400° C. to 600° C. and in that state steel material being held in the metallic net basket 2 is charged thereinto, the opening and closing center wall 22 is closed and the steel material is held until the temperature of the steel material becomes 300° C. to 400° C. Then the wall 22 is opened and the metallic net basket 2 with the steel works are transferred to the pretreating chamber 23 and in that state, fluorinated gas is fed into the pretreating chamber 23 to pretreat for 15 to 20 minutes. In this case, a vacuum pump 12 exhausts $O_2$ and $H_2O$ content in the pretreating chamber 23 before nitriding and maintains the pressure in the chamber 23 appropriately when nitriding. And after the pretreatment is over, gas in the pretreating chamber 23 is exhausted, then the center wall 22 is opened, the metallic net basket 2 with the steel works is moved to the nitriding chamber 24 having temperature of 400° C. to 600° C. and the wall 22 is closed. Next nitriding gas comprising a mixed gas of $NH_3$, $N_2$, $H_2$, CO and $CO_2$ is introduced into the nitriding chamber 24 to nitride for 4 to 5 hours. Then, inside temperature is lowered to 350° C. to 450° C., and in that state, cleaning is carried out by flowing a mixed gas of $H_2$ and $N_2$, or a mixed gas of $N_2$, $H_2$ and $CO_2$. After withdrawing the exhausted gas in the nitriding chamber 24 to outside, the center wall 22 is opened, the metallic net basket 2 having the steel works is charged into the pretreating chamber 23 and the center wall 22 is closed to cool the steel material therein in that state. In this case, cooling is conducted by flowing nitrogen gas via a gas inlet pipe 26 into the pretreating chamber 23. Thus the treated steel material has a nitrided layer formed deeply and uniformly on its surface.

EMBODIMENT 2

Figure 2:
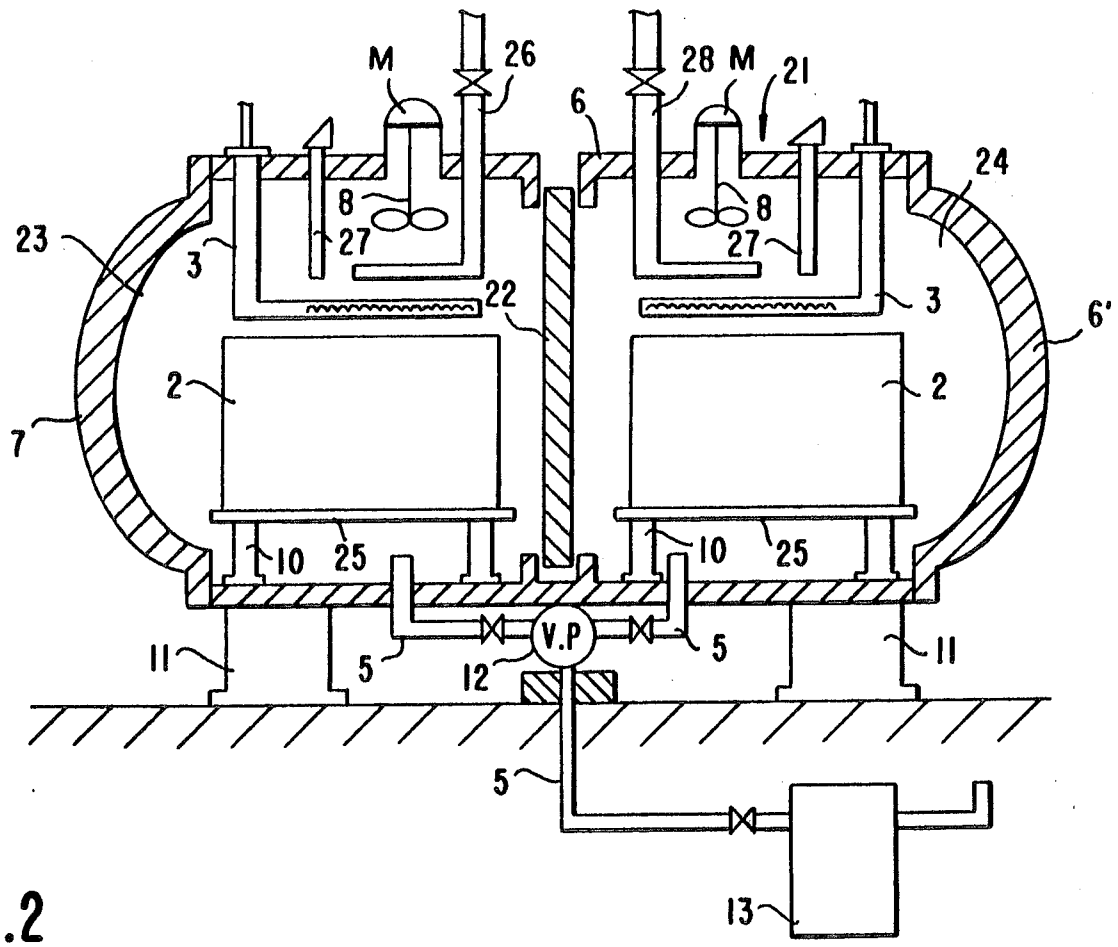
FIG. 2 shows a view of variation thereof.

FIG. 2 shows another embodiment according to the present invention. In this embodiment, a heater 3 is also disposed in the pretreating chamber 23, and a rear lid 6' of the nitriding chamber 24 is disposed so as to open laterally as well as that of the pretreating chamber 23. Other parts except the above-mentioned are actually the same as the Embodiment 1. Same parts or corresponding parts to the Embodiment 1 are indicated by the same reference numerals.

With the above-mentioned structure, the steel material can be heated in the pretreating chamber 23 to be able to pretreat the steel material therein. And after pretreating, the steel material is nitrided in the nitriding chamber 24. And the resultant steel material is taken out of the chamber 24 through the lateral-open type rear lid 6' to outside. Therefore, both pretreating in the pretreating chamber 23 and nitriding in the nitriding chamber can be carried out at the same time and continuous operation can be realized.

In the embodiment 2, an opening and closing door may be disposed on the bottom of the nitriding chamber 24, and an oil cooled drum may be disposed thereunder so as to cool the steel works in the oil cooled drum immediately after nitriding.

EFFECT OF THE INVENTION

As mentioned above, in the nitriding furnace apparatus according to the present invention, the furnace body is divided into a pretreating chamber and a nitriding chamber. Pretreating by fluorinated gas is conducted in the pretreating chamber, and nitriding in the nitriding chamber. Therefore, since a fluorinated layer which is adhered to wall surface of the pretreating chamber in a first treatment is maintained as it is without being decomposed and removed, fluorinated gas does not adhere to the wall surface but adhere only to the steel surface in the next treatment. As a result, a large amount of fluorinated gas to be consumed can be reduced and saved. Since exhausted gas such as $NH_4F$ produced by decomposition of the fluorinated layer is only from the fluorinated layer coating the steel surface, stopping up an exhaust gas pipe by formation of a large amount of $NH_4F$ does not occur. Yet, since it is possible to cool the steel material finished nitriding in the nitriding chamber by introducing it into the pretreating chamber of which temperature is lower than that of the nitriding chamber divided by an opening and closing center wall, it can save cooling time and thereby nitriding time can be shortened. In the case that the structure is made so that the steel material can be taken out of the nitriding chamber directly, it is possible to operate continuously and yet to correspond to the steel material which needs forced cooling such as oil cooling.

What we claim is:

1. A nitriding furnace apparatus, comprising:

a furnace body having an interior;

a heating apparatus disposed in said furnace body;

an openable and closeable center wall for selectably dividing said interior of said furnace body into two regions, one of said two regions comprising a nitriding chamber and the other one of said two regions comprising a pretreating chamber;

fluorinated gas supply means for supplying fluorinated gas to said pretreating chamber;

nitriding gas supply means for supplying nitriding gas to said nitriding chamber;

gas removing means for withdrawing gas from said nitriding chamber and from said pretreating chamber;

a support frame for supporting articles to be treated, said support frame being selectively movable between said two chambers;

wherein the articles to be treated initially are supported on said support frame in said pretreating chamber, and fluorinated gas is supplied to said pretreating chamber while said center wall is disposed such that it closes said pretreating chamber from said nitriding chamber; after pretreating, said fluorinated gas being removed by said gas removing means, after which said center wall is opened so that said support frame can be moved into said nitriding chamber; said center wall being closed and nitriding gas being supplied to said nitriding chamber by said nitriding gas supply means to nitride the articles; whereby a fluorinated layer is deposited in said interior of said furnace body substantially only in said pretreating chamber, so that removal of said fluorinated layer is unnecessary during subsequent cycles of pretreating in said pretreating chamber, thereby conserving fluorinating gas.

2. A nitriding furnace apparatus, comprising:

a furnace body having an interior;

a heating apparatus disposed in said furnace body;

an openable and closeable center wall for selectably dividing said interior of said furnace body into two regions, one of said two regions comprising a nitriding chamber and the other one of said two regions comprising a pretreating chamber;

fluorinated gas supply means for supplying fluorinated gas to said pretreating chamber;

nitriding gas supply means for supplying nitriding gas to said nitriding chamber;

gas removing means for withdrawing gas from said nitriding chamber and from said pretreating chamber;

a support frame for supporting articles to be treated, said support frame being selectively movable between said two chambers;

wherein the articles to be treated initially are supported on said support frame in said pretreating chamber, and fluorinated gas is supplied to said pretreating chamber while said center wall is disposed such that it closes said pretreating chamber from said nitriding chamber; after pretreating, said fluorinated gas being removed by said gas removing means, after which said center wall is opened so that said support frame can be moved into said nitriding chamber; said center wall being closed and nitriding gas being supplied to said nitriding chamber by said nitriding gas supply means to nitride the articles; whereby a fluorinated layer is deposited in said interior of said furnace body substantially only in said pretreating chamber, so that removal of said fluorinated layer is unnecessary during subsequent cycles of pretreating in said pretreating chamber, thereby conserving fluorinating gas;

wherein said heating apparatus is a first heating apparatus, and further comprising an additional heating apparatus, wherein said first heating apparatus is disposed in one of said nitriding chamber and said pretreating chamber, and said additional heating apparatus is disposed in the other of said nitriding chamber and said pretreating chamber.

3. A method of treating articles in a nitriding furnace, comprising:

providing a nitriding furnace having a furnace body having an interior, a heating apparatus disposed in said furnace body, an openable and closeable center wall for selectably dividing said interior of said furnace body into two regions, one of said two regions comprising a nitriding chamber and the other one of said two regions comprising a pretreating chamber;

providing fluorinated gas supply means for supplying fluorinated gas to said pretreating chamber;

providing nitriding gas supply means for supplying nitriding gas to said nitriding chamber;

providing gas removing means for withdrawing gas from said nitriding chamber and from said pretreating chamber;

providing a support frame for supporting articles to be treated, said support frame being selectively movable between said two chambers;

supporting articles to be treated on said support frame in said pretreating chamber;

supplying fluorinated gas to said pretreating chamber while said center wall is disposed such that it closes said pretreating chamber from said nitriding chamber;

after pretreating of the articles in said pretreating chamber, removing said fluorinated gas using said gas removing means;

opening said center wall after said fluorinated gas has been removed;

moving said support frame through the opening in said center wall into said nitriding chamber;

closing said center wall;

supplying nitriding gas to said nitriding chamber using said nitriding gas supply means, so as to nitride the articles; whereby a fluorinated layer is deposited in said interior of said furnace body substantially only in said pretreating chamber, so that removal of said fluorinated layer is unnecessary during subsequent cycles of pretreating in said pretreating chamber, thereby conserving fluorinating gas.

4. A nitriding furnace apparatus according to claim 1, further comprising a further door disposed in the bottom wall of said nitriding chamber and an oil-cooled drum disposed beneath said further door; said further door being selectably openable to release articles from said nitriding chamber into said oil-cooled drum, for cooling the articles immediately after nitriding.

* * * * *